US006425831B1

(12) United States Patent
Heene et al.

(10) Patent No.: US 6,425,831 B1
(45) Date of Patent: Jul. 30, 2002

(54) GOLF CLUB HEAD WITH A FACE INSERT HAVING INDICIA THEREON

(75) Inventors: Kevin A. Heene; Darren F. Lawlor, both of Carlsbad; Maxine J. Besaw, Vista; Clydene S. C. Nee, San Diego; Herbert Reyes, Laguna Niguel; Wayne H. Byrne, Murrieta; Pijush K. Dewanjee, Carlsbad; Richard C. Helmstetter, Rancho Santa Fe, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 1 day.

(21) Appl. No.: 09/692,744

(22) Filed: Oct. 18, 2000

Related U.S. Application Data

(63) Continuation-in-part of application No. 09/389,798, filed on Sep. 3, 1999, now Pat. No. 6,238,302.

(51) Int. Cl.[7] ..... A63B 53/04

(52) U.S. Cl. ..... 473/332; 473/340; 473/342

(58) Field of Search ..... 473/324, 329, 473/332, 342, 349, 251, 131, 249, 345, 350, 340

(56) References Cited

U.S. PATENT DOCUMENTS 3,333,854 A * 8/1967 White
3,884,477 A * 5/1975 Bianco
3,937,474 A * 2/1976 Jepson
4,618,149 A * 10/1986 Maxel
4,792,140 A * 12/1988 Yamaguchi
5,104,457 A 4/1992 Viljoen et al.
5,116,054 A 5/1992 Johnson
5,123,345 A 6/1992 Wood
5,255,919 A 10/1993 Johnson
5,333,861 A * 8/1994 Mills
5,433,446 A 7/1995 Lindstedt, Jr.
5,458,332 A * 10/1995 Fisher
5,460,377 A * 10/1995 Schmidt
5,485,997 A * 1/1996 Schmidt
5,489,098 A * 2/1996 Gojny
5,524,331 A * 6/1996 Pond
5,575,472 A * 11/1996 Magerman
5,586,948 A * 12/1996 Mick
5,637,265 A 6/1997 Misciagno et al.
5,643,111 A 7/1997 Igarashi
5,743,813 A * 4/1998 Chen
5,778,793 A * 7/1998 Mello
5,806,419 A 9/1998 Adner et al.
5,924,939 A 7/1999 Grace et al.
5,931,743 A * 8/1999 Baker
5,938,543 A * 8/1999 McGeeney
6,013,330 A 1/2000 Lutz
6,024,650 A 2/2000 Reeves
6,146,288 A * 11/2000 Crast
6,238,302 B1 * 5/2001 Helmstetter
6,245,386 B1 * 6/2001 Felker
6,273,831 B1 * 8/2001 Dewanjee

* cited by examiner

*Primary Examiner*—Sebastiano Passaniti
(74) *Attorney, Agent, or Firm*—Michael A. Catania

(57) ABSTRACT

A golf club head with a polymer insert having indicia printed directly on its surface is disclosed herein. The polymer insert is disposed in a recess of the club head, and is preferably composed of a thermosetting material. Preferably, an UV curable ink is utilized for the indicia. The UV ink is printed on the external surface of the insert through a transfer pad printing process, and then cured with UV energy. Preferably, the golf club head is a putter, and the insert is composed of a thermosetting polyurethane. The insert is preferably white, and the indicia is preferably multi-colored.

8 Claims, 3 Drawing Sheets

GOLF CLUB HEAD WITH A FACE INSERT HAVING INDICIA THEREON

CROSS REFERENCES TO RELATED APPLICATIONS

The present application is a continuation-in-part application of co-pending U.S. patent application Ser. No. 09/389,798, filed on Sept. 3,1999, now U.S. Pat. No. 6,238,802.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with a face insert having indicia thereon. More specifically, the present invention relates to a putter head with a polymer insert having indicia printed directly on the external surface of the insert.

2. Description of the Related Art

Throughout the history of golf, which dates back to as early as 1457, various techniques have been used to enhance the hitting characteristics of golf club heads. Golf club heads having inserts for the striking portion have been used at least as far back as 1880's when leather face irons were manufactured in Scotland. Golfer's in the 1890's were able to purchase putters with faces composed of gutta percha. More recently, inserts composed of various materials and shapes have been put forth by the creative geniuses of the golf industry to provide golfers with better feel and control of the golf ball.

One example is an ODYSSEY® putter having a STRONOMIC® insert that is disclosed in Magerman et al., U.S. Pat. No. 5,575,472 for a Golf Putter Head Having Face Insert And Method Of Forming The Same. The Magerman et al. Patent discloses a putter head with a recess into which is poured or inserted a resinous material which cures and is subsequently milled to produce the putter.

Another example is Pond, U.S. Pat. No. 5,524,331 for a Method For Manufacturing Golf Club Head With Integral Inserts that discloses a method for casting a graphite-epoxy composite insert within a recess of a face of a metal club head. The golf club head of the Pond Patent is directed at displacing the weight away from the center and increasing the moment of inertia.

Another example is Schmidt et al., U.S. Pat. No. 5,485,997, for a Golf Putter Head With Face Plate Insert Having Heightened Medial Portion, that discloses a putter head with a face plate composed of a non-metallic material such as an elastomer. The overall construction of the putter head of the Schmidt et al. Patent is directed at enlarging the sweet spot and improving the peripheral weighting.

Yet another example is found in Baker et al., U.S. Pat. No. 5,931,743 for a Putter Having Club Head With A Golf-Ball Engagement Insert And A Shaft Rearwardly Of The Insert which discloses a putter with a center shaft and an insert composed of a thermoplastic polyurethane. Another example is Jepson et al., U.S. Pat. No. 3,937,474 for a Golf Club With Polyurethane Insert, which discloses a wood having an insert on its striking face that is composed of a polyurethane formed from a tolylene diisocyanate polyether terminated prepolymer and a curing agent. The hardness of this insert varies from 40 to 75 shore D, and a Bashore Resiliometer of 17 or above. The polyurethane insert is claimed to impart additional energy to the golf ball during a golf hit.

Chen et al., U.S. Pat. No. 5,743,813 for a Golf Club Head discloses a wood composed of stainless steel with a three layer face having a first stainless steel layer, an elastic layer and a second stainless steel layer. The three-layer face does not absorb the hitting force when a golf ball is hit.

Fisher, U.S. Pat. No. 5,458,332, for a Golf Putter Head With A Cushioning Face, discloses a set of golf putters, each having an insert composed of polyurethane with a hardness in the range of 70 Shore A to about 80 Shore D. The rebound factor of each of the inserts is in the range of 12.5% to 50%, and the inserts are formulated to effect a reproducible direct linear relationship between the rebound factor and the distance of the putt.

Yet another example is McGeeney et al, European Patent Application Number 0891790 for a Multiple Density Golf Club Head And Method Of Manufacturing which discloses a putter with a central segment composed of a thermoplastic elastomer or a thermoset polymer. Possible thermoplastic elastomers include styrene co-polymers, co-polyesters, polyurethanes, polyamides, olefins and vulcanates. Possible thermoset polymers include epoxides, polyimides and polyester resins. The central segment has a minimum durometer hardness of Shore D 50. The central segment is bounded by metallic heel and to portions. However, the use of inserts is restrained in order to maintain the integrity of the game of golf.

Due to the lack of scorelines, insert face putters provide an advertising canvas that has yet to be exploited. One example is U.S. Pat. No. 5,924,939, to Grace et al. The Grace patent discloses a putter with a recess having a first insert with projections in the form of a word with a second insert over the first insert. Another example is U.S. Pat. No. 6,024,650 to Reeves for an Imprintable Golf Club Head which has a second on the rear of the club for printing purposes. Yet another example is U.S. Pat. No. 5,643,111 wherein a logo is attached to a rear cavity of the putter. Further examples include U.S. Pat. No. 5,104,457 wherein a circular emblem is placed within an aperture in the face. However, the prior art is absent a golf club head that has an insert with indicia printed directly on the external surface of the insert.

BRIEF SUMMARY OF THE INVENTION

The present invention provides a golf club head with an insert that has indicia printed directly on the external surface of the insert. The present invention is able to accomplish this by using an insert material that is favorable to direct printing, and ink that can withstand playing conditions.

One aspect of the present invention is a putter with an insert face that rests within a recess of the club head. The insert is composed of a polymer material and has a first indicia and a second indicia printed on each end of the insert. One indicia is a multiple color logo design while the other is a trademark of the particular club head. The ink is preferably a ultraviolet curable ink for greater abrasion resistance and greater durability.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
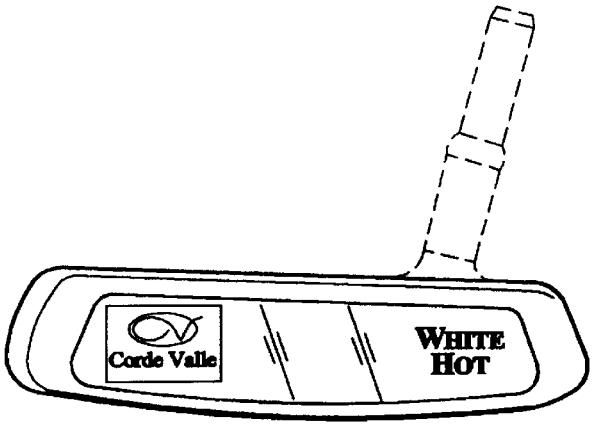
FIG. 1 is a front view of a golf club head with an insert therein.

As shown in FIGS. 1–5, a golf club of the present invention is generally designated 50. The golf club 50 includes a club head 52 having a body 54 with a front face 56 with a recess 58 therein. The club head 52 of the present invention also includes an insert 60 disposed within the recess 56. The insert 60 extends along most of the face 56 from a heel 62 of the club head 52 to a toe 64 of the club head 52, and from a sole 66 of the club head 52 to a crown 68 of the club head 52. The club head 52 also has a hosel 70 for connection to a shaft 72. Opposite of the front face 56 of the club head 52 is a rear 74 of the club head 52. Printed directly on the insert 60 is a first indicia 75 and a second indicia 77.

The body 54 of the club head 52 is preferably composed of a metallic material such as stainless steel. Other metallic materials include titanium, aluminum, tungsten, zinc, magnesium, and alloys of stainless steel and tungsten. However, those skilled in the pertinent art will recognize that the body 54 may be composed of other materials without departing from the scope and spirit of the present invention. Further, the non-insert portion of the face 56 may be smooth or textured to provide a consistent or non-consistent surface with the exterior surface of the insert. Additionally, the body 54 may be specifically weighted to provide a specific center of gravity and inertial properties for the golf club 50.

The golf club 50 is preferably a putter, but may be an iron (particularly a wedge) or a wood (particularly a utility wood). Preferred putters are flanged blade, mallet and semi-mallet putters, however, those skilled in the art will recognize that other similar putter designs may be utilized without departing from the scope and spirit of the present invention.

In a preferred embodiment, each of the club heads 52 weigh approximately 328 grams ±7 grams. Further, in a preferred embodiment, the recess 58 of each of the club heads 52 has a depth of approximately 0.205 inches ±0.010 inches.

Figure 2:
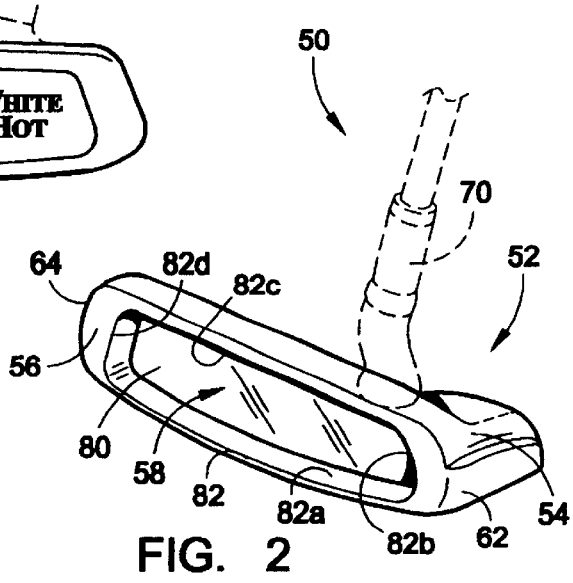
FIG. 2 is a perspective view of one embodiment of the golf club head of the present invention without an insert in the recess of the club head body.
Figure 3:
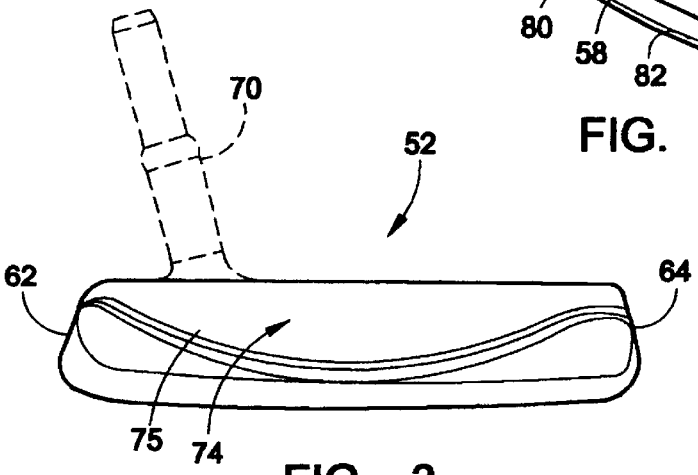
FIG. 3 is a rear view of the club head of FIG. 1.
Figure 5:
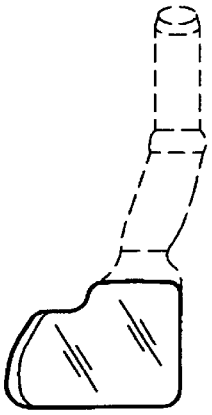
FIG. 5 is a side view of the club head of FIG. 1.
Figure 4:
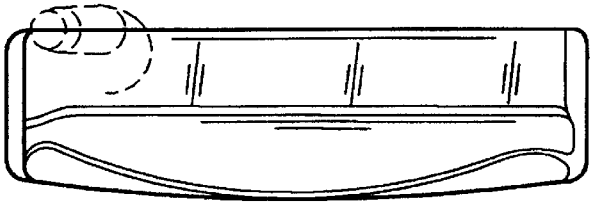
FIG. 4 is a top view of the club head of FIG. 1.
Figure 6:
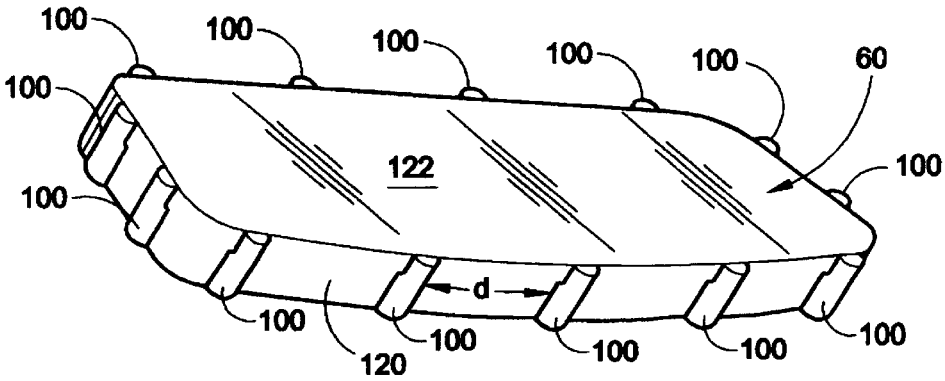
FIG. 6 is an isolated view of the insert.

Referring specifically to FIG. 2, the recess 58 of the body 54 is defined by a recess face wall 80 which is substantially parallel with the insert 60, and a recess edge wall 82 which is substantially perpendicular to the recess face wall 80. The recess face wall 80 defines the depth of the recess 58 that will determine the thickness of the polymer insert 60. The recess edge wall 82, as shown in FIG. 2, is composed of a bottom recess edge wall 82*a*, a heel recess edge wall 82*b*, a top recess edge wall 82*c* and a toe recess edge wall 82*d*. The recess edge wall 82 defines the shape of the recess 58, and the length of the recess edge wall 82 is determined by the depth of the recess 58. In a preferred embodiment, as shown in FIG. 6, the insert 60 has an external surface 90, an internal surface 92 and a perimeter 94 with a plurality of tabs 100 thereon. The tabs 100 assist in placement of the insert 60 within the recess 58.

The insert 60 may vary in shape and thickness depending on the design of the golf club 50. A preferred shape of the insert 60 is a trapezoidal shape with curved corners. An alternative shape is a trapezoidal shape with a panhandle. The weight of the insert 60 may be adjusted, and may vary in a range of 1.0%–5% of the weight of the club head 52. Further, the volume of the insert 60 may vary between 10% and 25% of the volume of the club head 52. Additionally, the percentage of the face area occupied by the insert 60 may vary between 55% and 75% of the total area of the face 56.

In a preferred embodiment, the insert 60 is composed of a polyurethane material as described in U.S. Pat. No. 6,273,831, entitled A Golf Club Head With A Polymer Insert, filed on Sep. 3, 1999, and hereby incorporated by reference in its entirety. However, the insert 60 may be composed of other polymer materials. Such polymer materials include ionomers, polyetheramides, thermoplastic polyurethanes, and the like.

The thickness of the insert 60 may vary depending on its application. A preferred thickness for a putter 50 is in the range of 0.125 to 0.500 inches. A preferred range of thicknesses is 0.188 inches to 0.200 inches. A preferred thickness is 0.198 inches. The thickness of the insert 60 is increased or decreased to influence the feel to the golfer during impact with a golf ball.

Preferably, the natural color of the insert 60 is white or an off-white, and the insert 60 may be painted with a basecoat to enhance its white color. Although white is the preferred coloring for the insert 60, all other colors may be used in practicing the present invention. The insert 60 may be coated with a protective coating such as a lacquer or a clear coat. Such coatings include two component polyurethane clear coats, UV-curable clear coats and dual-curable 45 coatings. The thickness of the coating is preferably from 0.001 inch to 0.009 inch.

A preferred dual-curable coating formulation for application to the external surface of the insert 60 is set forth below. The preferred dual-curable coating has a polyol component and a polyisocyanate component. The polyol component for the dual-curable coating is preferably composed of a white pigment grind base in an amount of 60 parts per weight of the polyol component; a solvent blend in an amount of 30 parts per weight of the polyol component; 2,4-pentanedione in an amount of 2 parts per weight of the polyol component; an adhesion promoter in an amount of 2.80 parts per weight of the polyol component; pentaerytiritol triacrylate ("PETA") in an amount of 5 parts per weight of the polyol component; and tinting aids in an amount of 0.20 parts per weight of the polyol component. In this preferred embodiment, the polyisocyanate component contains ethyl acetate in an amount of 44 wt. %; a trimer of HDI in an amount of 18 wt. %; and a biuret of HDI in an amount of 38 wt. %. A more detailed explanation of a dual-curable coating is set forth in co-pending U.S. patent application Ser. No.

09/593,574, filed on Jun. 14, 2000, which is hereby incorporated by reference.

A preferred clear coat formulation for application to the external surface of the insert 60 is set forth below. The preferred clear coat has a polyol component and a polyisocyanate component. The polyol component is preferably composed of a solvent blend containing butyl acetate in an amount of 15 wt. % and ethyl acetate in an amount of 39 wt. %. The polyol component also contains NPG resin in an amount of 40 wt. %; polyfunctional aziridine in an amount of 2 wt. %; thixotropic resin in an amount of 1.0 wt. %; epoxidized silane in an amount of 0.5 wt. %; non-ionic flow additive in an amount of 0.5 wt. %; and dibutyltin dilaureate (catalyst) in an amount of 2.0 wt. %. In this preferred embodiment, the polyisocyanate component contains ethyl acetate in an amount of 44 wt. %; a trimer of HDI in an amount of 18 wt. %; and a biuret of HDI in an amount of 38 wt. %. A more detailed explanation of a two component polyurethane coating is set forth in U.S. Pat. No. 6,365,679, filed on Feb. 1, 2000, which is hereby incorporated by reference.

A preferred ultraviolet ("UV") curable coat formulation for application to the external surface of the insert 60 is set forth below. The four principal components of the UV-curable coating include: (1) one or more low viscosity modified polyether acrylates; (2) a functional carbodiimide resin; (3) one or more low viscosity aliphatic urethane polyacrylate oligomers; and (4) a photoinitiator. The UV-curable coating formulation contemplates no low molecular weight functional monomer dilutents. A more detailed explanation of an UV-curable coating is set forth in U.S. Pat. No. 6,146,288, filed on May 12, 1999, which is hereby incorporated by reference.

The main aspect of the present invention is the printing of the first indicia 75 and the second indicia 77 directly on the external surface 90 of the insert 60, whether the external surface is coated or uncoated. As shown on FIG. 1, the first indicia 75 is printed directly on the toe end of the club head 52 and the second indicia 77 is printed directly on the heel end of the club head 52. The indicia may be composed of various inks that allow for direct printing on a polymer substrate, or coated polymer substrate. A preferred ink is an UV curable ink sold under the trade name UVAB and available from Trans Tech of Carol Stream, Ill. The ink includes an UV curable resin, a coloring agent, a pigment/dye and a photoinitiator. Another UV curable ink is sold under the trade name PRISMFLEX and is available from Sun Chemical. An alternative ink is a two component ink containing an epoxy for quick hardening/curing. Two such two component inks are sold under the brand name Type B and Type W and available from Trans Tech. Another such two component ink is sold under the trade name MARIBU, and is available from Autoroll. Yet another such two component ink is TPC-230, available from Teca Print. A more detail explanation of the use of the inks in the present invention is discussed below.

Figure 7:
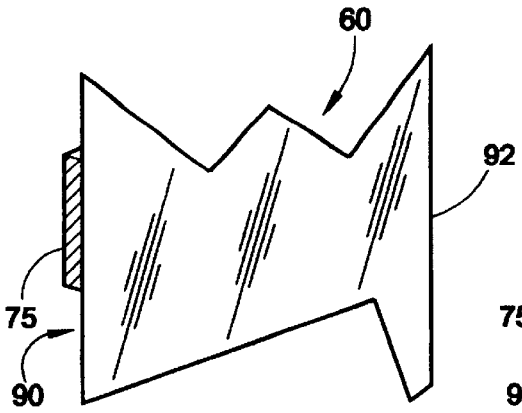
FIG. 7 is an enlarged isolated side view of the insert with indicia printed on the surface of the insert material.

As shown in FIGS. 7–10, the construction of the external surface 90 of the insert 60 may vary depending on the material of the insert 60 and the ink used for the first indicia 75. As shown in FIG. 7, the first indicia 75 is printed directly on the uncoated insert 60, thus the ink must adhere to the material of the insert 60. The first indicia 75 is therefore composed of an ink that adheres to thermosetting polyurethane if the insert 60 is composed of thermosetting polyurethane.

Figure 8:
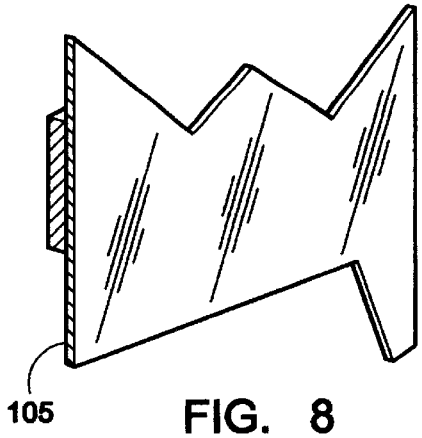
FIG. 8 is an enlarged isolated side view of the insert with indicia printed on a top coated surface of the insert.

As shown in FIG. 8, a top coat 105 is applied to the insert 60 creating a coated external surface 90. The first indicia 75 is then printed directly on the top coat 105. Preferably, the top coat 105 is two-component polyurethane or a UV curable coating as discussed above.

Figure 9:
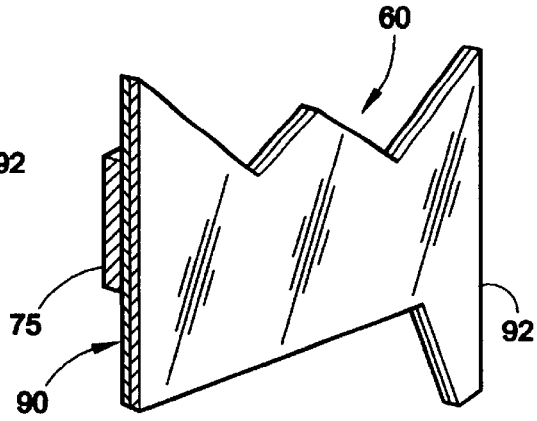
FIG. 9 is an enlarged isolated side view of the insert with indicia printed on a top coated and base coated surface of the insert.

As shown in FIG. 9, a base coat 107 is applied to the insert 60 and a top coat 105 is applied over the base coat 107 thereby creating a dual coated external surface 90. The base coat 107 is a conventional pigmented base coat while the top coat 105 is preferably a dual curable coating, two-component polyurethane or a UV curable coating as discussed above. The first indicia 75 is printed directly on the top coat 105.

Figure 10:
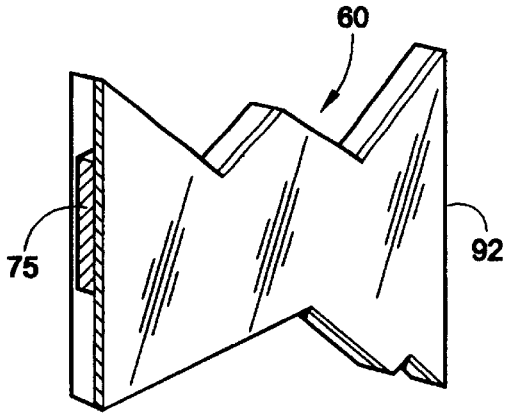
FIG. 10 is an enlarged isolated side view of the insert with indicia printed on a base coated surface of the insert and a top coat applied over the indicia.

Yet another embodiment is shown in FIG. 10 wherein a base coat 107 is applied to the 11-5 insert 60 and the first indicia 75 is printed directly to the base coat 107. A top coat 105 is then applied over the first indicia 75. The top coat 105 is preferably a dual curable coating, two-component polyurethane or a UV curable coating as discussed above. Those skilled in the pertinent art will recognize a multitude of external surface structures that may be used without departing from the scope and content of the present invention.

Preferably, the insert 60 is secured within the recess 58 of the club head 52 prior to printing of the indicia 75. However, either the first indicia 75 and/or second indicia 77 may be printed on the insert 60 prior to placement within the recess 58. Several printing methods may be utilized in practicing the present invention. A preferred method is a pad printing and UV curing process. An alternative method is a pad printing and convection oven curing process. Yet another embodiment is a hot stamping process. Yet a further embodiment is a silk screening process.

Figure 11:
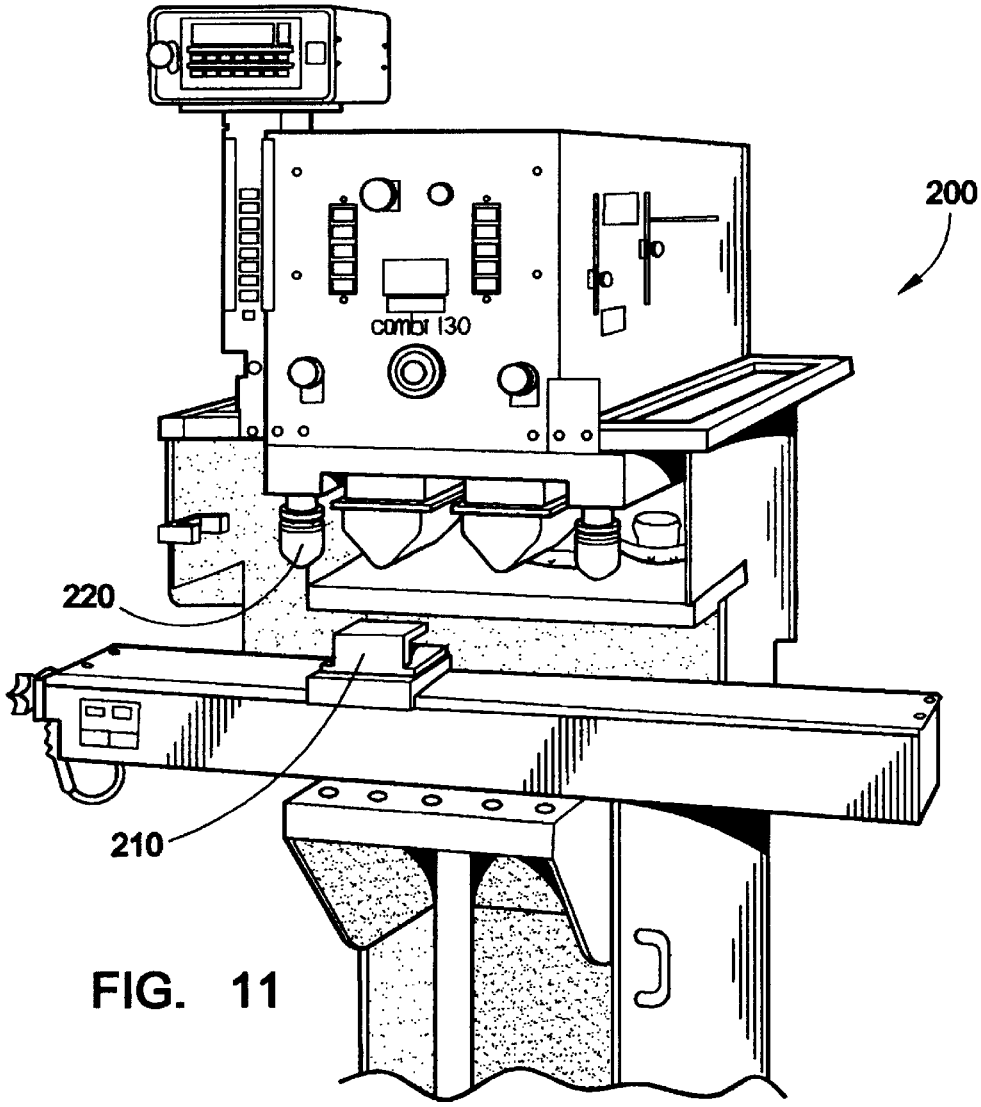
FIG. 11 is a perspective view of a transfer pad printing machine.
Figure 12:
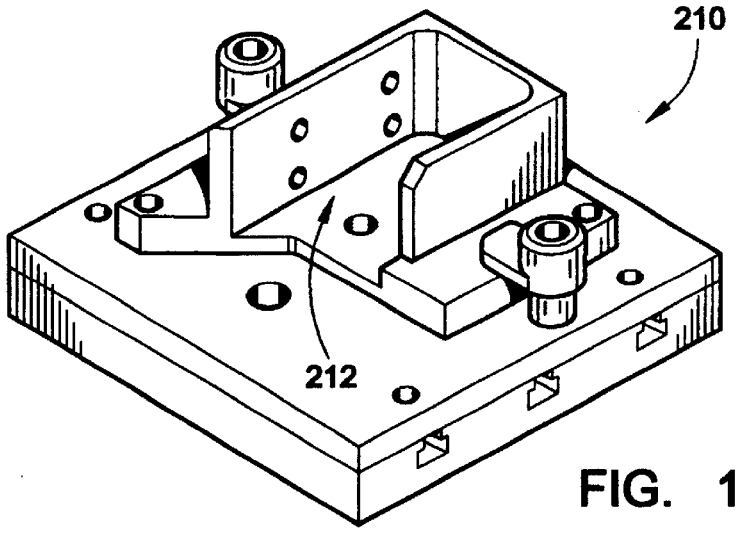
FIG. 12 is an isolated view of a base for retaining a club head during the printing process.

As mentioned above, a preferred embodiment is use of a transfer pad printing system with an UV curable ink, and cured with UV energy/radiation. FIG. 11 illustrates such a transfer pad printing system 200 that may be used in practicing the present invention. Such a system 200 is available from Trans Tech under the brand name COMBI 130. In operation, a club head 52 with an insert 60 therein is placed within a base 210, as shown in FIG. 12, that has a club head containment recess 212 for placement of the club head 52 therein. The club head 52 is placed within the base 200 with the insert 60 exposed for printing thereon. The club head 52 is secured within the club head containment recess 212, and then positioned under each of the printing pads 220 for printing of the indicia 75 thereon. Each printing pad 220 transfers ink with a distinct color to the external surface 90 of the insert 60. If the indicia 75 is a multiple color indicia (preferably 1–5 colors), then multiple print pads 220 will be utilized during the printing operation. Subsequent to printing, the club head 52 with the indicia 75 printed on the insert 60, is removed from the base and exposed to UV energy for curing. A preferred energy is 1.6 Joules/centimeter$^2$ to 2.8 joules per centimeter$^2$, at a wavelength of 254 nanometers to 365 nanometers. Such a process allows for rapid curing of the ink thereby decreasing the production cycle.

The indicia 75 may be a logo design or trademark for an organization. The artwork for the indicia 75 is typically scanned into electronic form to place into a proper image format. The electronic image is then placed on a putter insert template for proper positioning and proportions. The image is then photo-etched on a disposable plate, or a steel plate, for the transfer pad printing process. The etched image is flooded with ink that is then transferred to the printing pad 220 of the pad printing system 200, then printed on the external surface of the insert 60. Each color is printed by a separate printing pad 220.

A wet ink process using a heat convection oven is the same as the above-described transfer pad printing process except the ink is different and the ink is cured using an oven instead of UV energy.

Yet another method for printing the indicia 75 on the insert 60 is a hot stamp process that uses a heat die compress. A foil is compressed against the external surface 90 of the insert 60 to print the indicia 75 on the external surface 90.

Yet another method is a silk screening method that uses a mesh screen to determine the location of the ink. The ink is then applied through a screen and eventually on the external surface 90 of the insert 60. The printed indicia is then allowed to dry for a sufficient time period.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A putter-type golf club head comprsing:

a club head body having a sole, a crown and a front face with a recess therein, the insert has a thickness of 0.100 inch to 0.750 inch the front face disposed between the crown and the sole, the club head body composed of a metal material;

an insert for contacting a golf ball, the insert disposed within the recess of the front face, the insert comprising a substrate with an exterior surface and an interior surface, the insert having a thickness ranging from 0.125 inch to 0.500 inch, the exterior surface of the substrate having a protective coating thereon, the protective coating having a thickness of between 0.001 inch and 0.009 inch, the insert composed of a polyurethane material;

indicia printed directly on the protective coating of the exterior surface of the insert, the indicia composed of an ultraviolet curable ink capable of withstanding playing conditions.

2. The putter-type golf club head according to claim 1 wherein the coating is a two component polyurethane coating.

3. The putter-type golf club head according to claim 1 wherein the coating is a UV-curable coating comprising at least one low viscosity polyether acrylate, a functional carbodiimide resin, at least one low viscosity urethane acrylate oligomer, and a photoinitiator.

4. The putter-type golf club head according to claim 1 wherein the coating comprises pentaerythritol tetraacrylate.

5. The putter-type golf club head according to claim 1 wherein the coating comprises a polyester polyol resin component and a polyisocyanate component wherein the polyester polyol resin component contains a neopentyl glycol resin in an amount of 40 to 80 weight percentage of the polyol resin component.

6. The putter type club head according to claim 1 wherein the indicia is a multiple color indicia.

7. The putter-type club head according to claim 1 wherein the insert has a white color.

8. The putter-type golf club head according to claim 1 further comprising an additional indicia, the indicia disposed on a heel end of the insert and the additional indicia disposed on a toe end of the insert.

* * * * *